US005101733A

United States Patent [19]

Mohr

[11] Patent Number: 5,101,733

[45] Date of Patent: Apr. 7, 1992

[54] BALLAST TAMPING MACHINE WITH FLEXIBLE BALLAST CONVEYING TUBES MOUNTED ON THE CARRIER FRAME OF THE TAMPING HEADS TO PLACE BALLAST AT TAMPING TOOLS

[75] Inventor: Pierre Mohr, Ligny en Barrois, France

[73] Assignee: Franz Plasser Bahnbaumaschinen-Industriegesellschaft m.b.H., Vienna, Austria

[21] Appl. No.: 616,780

[22] Filed: Nov. 20, 1990

[30] Foreign Application Priority Data

Jan. 10, 1990 [EP] European Pat. Off. ..... 90100427.5

[51] Int. Cl.[5] ..... E01B 27/02

[52] U.S. Cl. ..... 104/12; 104/2; 37/104; 171/16

[58] Field of Search ..... 104/2, 10, 11, 12; 37/104; 171/16

[56] References Cited

U.S. PATENT DOCUMENTS

| | | | |
|---|---|---|---|
| 3,942,448 | 3/1976 | Unbehaun et al. | 104/11 |
| 4,497,256 | 2/1985 | Hansmann et al. | 104/12 X |
| 4,794,862 | 1/1989 | Theurer | 104/12 X |
| 4,809,617 | 3/1989 | Theurer et al. | 104/2 X |
| 4,881,467 | 11/1989 | Theurer | 104/12 X |

FOREIGN PATENT DOCUMENTS 0185834 1/1988 European Pat. Off. .

*Primary Examiner*—Robert J. Oberleitner
*Assistant Examiner*—S. Joseph Morano
*Attorney, Agent, or Firm*—Collard, Roe & Galgano

[57] ABSTRACT

A ballast tamping machine comprises a tamping head comprising pairs of vibratory tamping tools immersible in the ballast and reciprocable in the operating direction and opposite thereto for tamping ballast under the ties, a track lifting and lining unit preceding the tamping head in the operating direction, and a device for substantially uniformly distributing ballast. The device has an outlet associated with each tamping tool for discharging ballast at the associated tamping tool.

12 Claims, 2 Drawing Sheets

BALLAST TAMPING MACHINE WITH FLEXIBLE BALLAST CONVEYING TUBES MOUNTED ON THE CARRIER FRAME OF THE TAMPING HEADS TO PLACE BALLAST AT TAMPING TOOLS

BACKGROUND OF THE INVENTION

1. Field of the Invention

The present invention relates to a ballast tamping machine mounted for mobility in an operating direction on a railroad track comprising two rails fastened to ties supported on a ballast bed, which comprises a tamping head comprising pairs of vibratory tamping tools immersible in the ballast and reciprocable in the operating direction and opposite thereto for tamping ballast under the ties, a track lifting and lining unit preceding the tamping head in the operating direction, and a device having outlets for substantially uniformly distributing ballast.

2. Description of the Prior Art

A track leveling and ballast tamping machine of this type has been disclosed in U.S. Pat. No. 4,794,862, dated Jan. 3, 1989. The ballast distributing device of this machine comprises a ballast storage container preceding the tamping heads in the operating direction an having controllable ballast discharge chutes. A front end of the machine may carry a ballast sweeping device for sweeping up ballast or a center ballast plow to deliver the swept-up or plowed ballast to an input end of a ballast conveyor arrangement whose output end discharges the conveyed ballast into the storage container. The machine follows a ballast cleaning machine producing varying amounts of cleaned ballast for redistribution to the ballast bed, the amount of cleaned ballast depending on the amount of waste removed by the ballast cleaning machine, and the ballast distributing device compensates for these variations and thus assures at least somewhat uniform distribution of ballast for tamping by storing any excess ballast coming from the ballast cleaning machine in the container while discharging stored cleaned ballast from the container when the ballast cleaning machine produces too little cleaned ballast.

U.S. Pat. No. 4,497,256, dated Feb. 5, 1985, discloses a mobile track leveling and ballast tamping machine comprising a pneumatic arrangement for blowing ballast under the raised ties. The pneumatic arrangement comprises a ballast storage container arranged to deliver stored ballast to blow pipes immersible in the ballast bed alongside a longitudinal edge of a respective track tie at the field and gage sides of the rails. Each pipe has a tapered end defining a ballast outlet facing the tie, the outlet having a cross section only slightly exceeding that of the pipe. A metering device is arranged between the storage container and the blow pipe for metering the delivered amount of ballast.

SUMMARY OF THE INVENTION

It is the primary object of this invention to improve a ballast tamping machine of the first-described type so that it may perform high-quality tie tamping even in track sections whose cribs contain relatively little ballast.

The above and other objects are accomplished in such a ballast tamping machine according to the invention by providing the ballast distributing device with an outlet associated with each tamping tool for discharging ballast at the associated tamping tool.

By arranging a ballast discharge outlet directly at each tamping tool, it has become possible for the first time to distribute a metered amount of ballast directly within the tamping range of each crib immediately before the tamping tools are reciprocated for tamping the ballast under the ties. It is an added advantage that the same operator who controls the tamping operation may also control the discharge of the desired amount of distributed ballast. In this way, the uniformity and resultant long-lasting quality of the tamping may be assured along long track sections whose cribs have varying ballast densities, which previously has been possible only by the very expensive use of special ballast plows preceding the tampers.

According to a preferred feature of the present invention, the outlet precedes the associated tamping tool in the directions of reciprocation of each pair of tamping tools. This reduces the path of the discharged ballast to the short distance between the outlet and the surface of the ballast bed so that the ballast distribution may be effected in a very short time.

In accordance with another preferred feature of this invention, each outlet has a closure and a central control is provided for actuating the outlet closures for opening and closing the outlets. This enables the amount of distributed ballast to be accurately metered.

The tamping head comprises a tamping tool carrier frame and the ballast distributing device preferably comprises at least partially flexible ballast distributing tubes on the carrier frame, a respective one of the outlets being connected to one end of a respective one of the ballast distributing tubes, and a funnel-shaped bin communicating with an end of the ballast distributing tubes opposite the one end thereof. The use of such tubes enables the ballast to be continuously delivered to the outlets for distribution without interfering with the operation of the reciprocating tamping tools. The carrier frame may define respective bores forming a part of the ballast distributing tubes, each bore having an end at the lower end of the carrier frame forming the one end to which a respective one of the outlets is connected. This constitutes a particularly simple construction of the ballast distributing tubes and interferes neither with the vertical adjustability of the tamping head or the reciprocation of the tamping tools. If a flexible tubing connects the bin to an upper end of each bore to form a flexible part of the ballast distributing tubes, the tamping head may be readily displaced transversely to center the tamping tools with respect to the associated rail.

According to another preferred feature, the ballast distributing device further comprises a ballast storage container arranged above the bin and in communication therewith. This assures a sufficient amount of ballast being stored so that ballast is available for distribution along a long stretch of track under various ballasting conditions. If the ballast distributing device further comprises a ballast conveyor band forming a bottom of the storage container and a drive for driving the conveyor band in a conveying direction towards the bin, the ballast may be exactly metered in a simple structure for distribution. This metering may be effected by controlling the conveyor band drive to convey a desired amount of ballast from the storage container to the bin for gravity distribution through the distrubing tubes and outlets.

As is known and preferred, the ballast distributing device may further comprise a ballast conveyor arrangement arranged above the ballast storage container, the ballast conveyor arrangement having an input end and an output end arranged to discharge conveyed ballast into the storage container, and a vertically adjustable ballast sweeping device arranged rearwardly of the outlets in the operating direction to sweep up ballast and to deliver the swept-up ballast to the input end of the ballast conveyor arrangement. This enables the storage container to be automatically filled with ballast in track sections with excess ballast so that the machine may operate without interruption over long streches of track. If a vertically adjustable central ballast plow is arranged between the outlets and the ballast sweeping device for plowing ballast in the central region of the track between the rails, and a shoulder plow at each side of the machine precedes the center plow in the operating direction for plowing ballast at the track shoulders, any excess ballast will be transferred from the shoulders to the center region and will be swept up by the sweeping device for conveyance to the storage container.

In most ballast tamping machines, a respective tamping head is associated with each rail, each tamping head comprising a tamping tool carrier frame, in which case a respective ballast distributing device is associated with each tamping head, and each ballast distributing device preferably comprises at least partially flexible ballast distributing tubes on the carrier frames, a respective one of the outlets is connected to one end of a respective one of the ballast distributing tubes, a funnel-shaped bin communicates with an end of the ballast distributing tubes opposite the one end thereof. A ballast storage container is arranged above the bins and in communication therewith, two ballast conveyor bands form a bottom of the storage container and a drive drives the conveyor bands in a conveying direction towards the bins, the bottom conveyor bands being arranged in a common horizontal plane side-by-side in a direction extending transversely to the machine. Such independently operable ballast conveyor bands feeding the bins at each tamping head enable the distributed ballast to be accurately metered at each tamping head in a very simple structural arrangement. In this manner, different amounts of ballast may be distributed at each rail when ballast is tamped under a tie so that, for example, a tie may be tamped with a distributed amount of ballast at one rail while tamping is impossible at the other rail because of some track obstacle there.

In one preferred embodiment, the tamping head comprises a tamping tool carrier frame having two opposite sides extending parallel to the longitudinal extension of the machine, a respective one of the pairs of tamping tools being arranged at each side, and the ballast distributing device comprises a respective ballast distributing tube extending centrally between each pair of tamping tools and having two of said outlets respectively associated with each tamping tool of the pair. This arrangement is particularly useful when the ballast distributing device of the present invention is to be retrofitted on an existing ballast tamping machine. It also enables such a machine to be changed quickly for operation in track sections which require no special ballast distributing devices.

In another preferred embodiment of a ballast tamping machine comprising a respective tamping head associated with each rail and each tamping head comprising a tamping tool carrier frame, the ballast distributing device comprises a substantially vertically extending ballast distributing tube arranged centrally between the tamping tool carrier frames and respective branch tubes extending from a lower end of the vertically extending tube towards each carrier frame, the branch tubes being affixed to the carrier frames and having the outlets associated with the tamping tools of each tamping head connected thereto. The centered arrangement of the ballast distributing device requires no structural changes in the tamping heads themselves.

BRIEF DESCRIPTION OF THE DRAWING

The above and other objects, advantages and features of this invention will now be described in detail in connection with certain now preferred embodiments thereof, taken in conjunction with the accompanying, partly schematic drawing wherein.

DETAILED DESCRIPTION OF PREFERRED EMBODIMENTS

Figures 1, 2, 3:
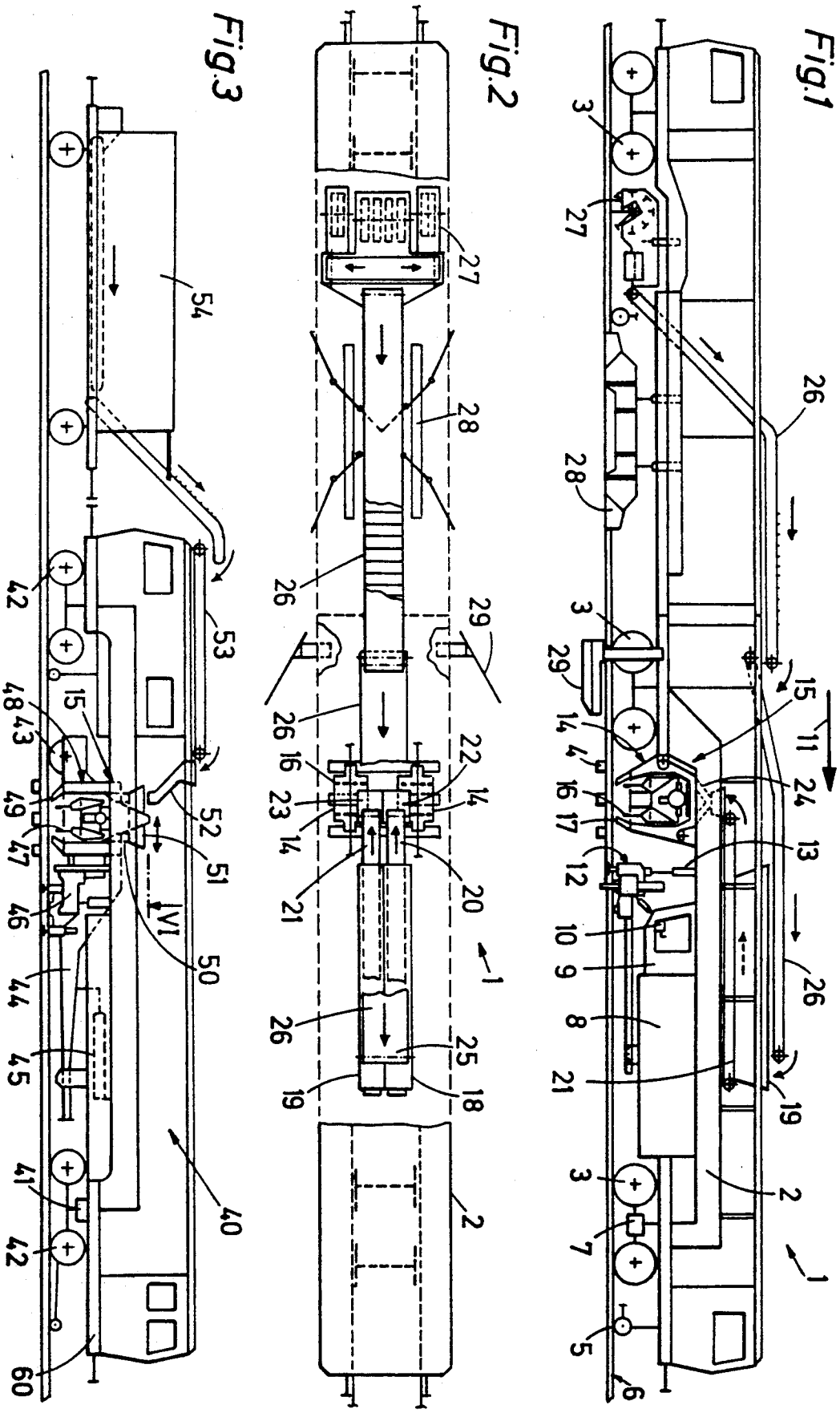
FIG. 1 is a diagrammatic side elevational view of a ballast tamping machine incorporating the ballast distributing device of the invention.
FIG. 2 is a diagrammatic top view of the machine of FIG. 1.
FIG. 3 is a diagrammatic side elevational view of another embodiment wherein the ballast distributing device is incorporated into a continuous-action ballast tamping machine.

Referring now to the drawing and first to FIGS. 1 and 2, there is shown ballast tamping machine 1 mounted for mobility in an operating direction indicated by arrow 11 on railroad track 6 comprising two rails 5 fastened to ties 4 supported on a ballast bed. The illustrated machine comprises two-part elongated machine frame 2 whose parts are linked together and which is supported on the track by undercarriages 3. The machine is propelled along the track by drive 7 and power plant 8 is mounted on the machine frame to supply energy to this drive and all the operating drives on the machine. Operator's cab 9 housing central control panel 10 is arranged within view of the operating units of the machine, about midway between two of the undercarriages supporting the leading machine frame part. Ballast tamping machine 1 comprises a respective tamping head 14 associated with each rail 5, each tamping head comprising pairs 16 of vibratory tamping tools 33 immersible in the ballast and reciprocable in the operating direction and opposite thereto for tamping ballast under ties 4, and the machine further comprises track lifting and lining unit 12 preceding the tamping head in the operating direction and linked to machine frame 2 by lifting and lining drives 13.

Figure 4:
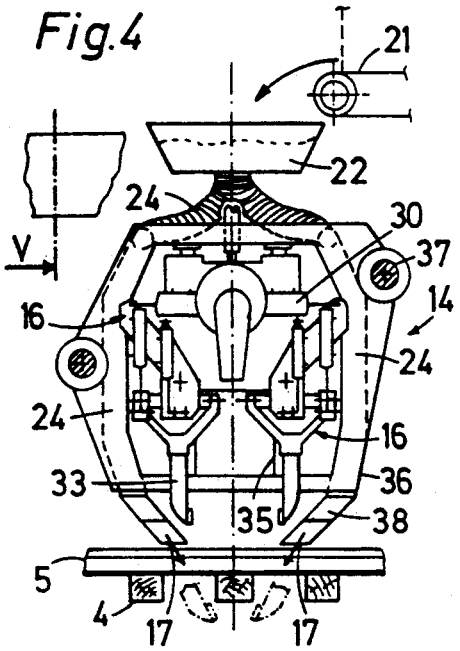
FIG. 4 is an enlarged, fragmentary side elevational view of the machine of FIGS. 1 and 2, showing the ballast distributing device with the outlets associated with each tamping tool in detail.
Figure 5:
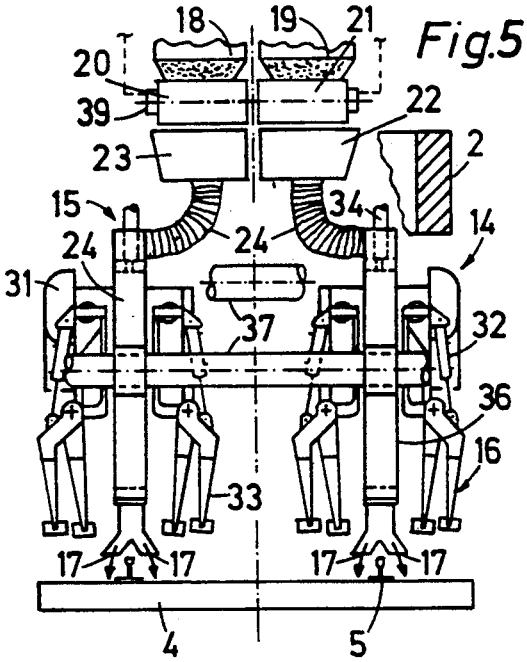
FIG. 5 is an end view taken in the direction of arrow V in FIG. 4, showing respective tamping heads associated with the rails and the ballast distributing devices associated with the tamping heads.

According to the present invention, the machine has device 15 for substantially uniformly distributing ballast, the device having an outlet 17 associated with each tamping tool 16 for discharging ballast at the associated tamping tool. As shown in FIG. 4, each outlet 17 precedes the associated tamping tool in the directions of reciprocation of each pair of tamping tools. Each outlet has a closure actuatable by central control 10 for opening and closing the outlets. As shown in FIGS. 4 and 5, each tamping head comprises tamping tool carrier frame 36 and ballast distributing device 15 comprises partially flexible ballast distributing tubes 24 on the carrier frame, a respective outlet 17 being connected to one end of a respective ballast distributing tube 24. Funnel-shaped bin 22, 23 communicates with an end of ballast distributing tubes 24 opposite the one end thereof. In this embodiment, carrier frame 36 defines respective bores forming a part of ballast distributing tubes 24, each bore having an end at the lower end of the carrier frame forming the one end to which a respective one of the outlets is connected, and a flexible tubing connects the bin to an upper end of each bore to form a flexible part of the ballast distributing tubes.

In the illustrated embodiment, ballast distributing device 15 for each tamping head further comprises ballast storage container 18, 19 arranged above bin 23, 22 and in communication therewith. Ballast conveyor band 20, 21 is driven by drive 39 in a conveying direction towards respective bin 23, 22, each conveyor band forming a bottom of respective storage container 18, 19 and discharging the ballast conveyed from the storage container into the bin at a rear output end of the conveyor band. Furthermore, ballast conveyor arrangement 26 is arranged above ballast storage containers 18, 19, the ballast conveyor arrangement having an input end and output end 25 arranged to discharge conveyed ballast into the storage containers, and vertically adjustable ballast sweeping device 27 is arranged rearwardly of outlets 17 in the operating direction to sweep up ballast and to deliver the swept-up ballast to the input end of ballast conveyor arrangement 26. Between tamping heads 14, 14, vertically adjustable central ballast plow 28 is arranged between outlets 17 and ballast sweeping device 27 for plowing ballast in the central region of track 6 between rails 5, and vertically and transversely adjustable shoulder plow 29 at each side of machine 1 precedes center plow 28 in the operating direction for plowing ballast at the track shoulders.

As described hereinabove and clearly shown in FIGS. 4 and 5, a respective tamping head 14 is associated with each rail 5, each tamping head comprising tamping tool carrier frame 36, and respective ballast distributing device 15 is associated with each tamping head 14. Each tamping head comprises two pairs 16 of tamping tools 33, one pair being arranged at the field side and one pair at the gage side of each rail 5. Drives 30, 31 are connected to the pairs of tamping tools for vibrating the tamping tools and for reciprocating the same towards ties 4 which are straddled by the pairs of tamping tools. In addition, an independent drive 32 is linked to each tamping tool for independently pivoting each tool in a transverse plane. Vertical guide posts 35 are affixed to each tamping tool carrier frame 36 and vertically adjustably mount a respective tamping head on the vertical guide posts for vertical adjustment by drive 34. Horizontal guide posts 37 extending transversely to the longitudinal extension of machine 1 support tamping tool carrier frame 36 for transverse displacement so that the tamping tools may be properly centered with respect to rails 5. Each ballast distributing device 15 comprises partially flexible ballast distributing tubes 24 on carrier frames 36, a respective outlet 17 being connected to one end of a respective ballast distributing tube, and respective funnel-shaped bin 22, 23 communicating with an end of the ballast distributing tubes opposite the one end thereof. In this embodiment, tamping tool carrier frame 36 defines bores constituting a portion of ballast distributing tubes 24, ballast distributing attachments 38 being detachably connected to the lower ends of the bores and each attachment 38 having two outlets 17 transversely spaced from each other and oriented respectively towards a field-side and gage-side pair 16 of tamping tools 33. The upper ends of the ballast distributing bores in the tamping tool carrier frame are connected by flexible hoses to bins 22, 23.

The operation of the above-described machine will now be described in detail:

During a tie tamping operation, shoulder plows 29 are so adjusted vertically and/or transversely so that excess ballast is transferred from the track shoulders towards the center of the track where center plow 28 may be operated to concentrate the excess ballast in this area. The rotary broom of sweeping device 27 is operated to sweep up this excess ballast and to convey it to ballast conveyor arrangement 26 for conveyance to storage containers 18, 19 in which the excess ballast is stored. In track sections, such as switches, where the cribs contain too little ballast for satisfactory tamping, drives 39 are actuated until sufficient stored ballast has been conveyed from containers 18, 19 into bins 23, 22 whence the ballast is conveyed by gravity through distributing tubes 24 to outlets 17 which deliver ballast to tamping tools 33 for proper tamping. Remote-controllable closures at the outlets enable the flow of ballast through the outlets to be so controlled that the ballast may be delivered very rapidly, on the one hand, and quickly stopped, on the other hand, when a track obstacle is encountered at one of the outlets, which makes tamping by the adjacent tamping tool impossible and where, therefore, no ballast delivery is desired. Because the upper portion of the ballast distributing tubes is flexible, tamping heads 14 may be readily displaced transversely for proper centering in switch or curve sections of the track. When the tamping operation has been completed and the machine is ready to be driven to another operating site, ballast distributing attachments 38 are detached.

Figure 6:
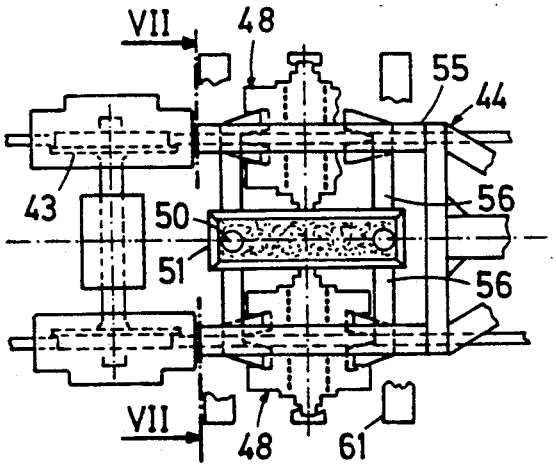
FIG. 6 is an enlarged top view taken in the direction of arrow VI in FIG. 3, showing a centrally arranged ballast storage container for the ballast distributing devices associated with the tamping heads at each rail.
Figure 7:
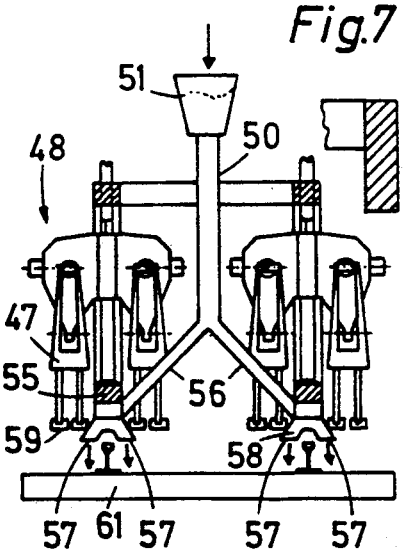
FIG. 7 is a cross section along line VII—VII of FIG. 6.

FIG. 3 illustrates continuous action ballast tamping machine 40 whose machine frame 60 is continuously propelled by drive 41 in an operating direction during a tamping operation while carrier frame 44 is intermittently displaced by drive 45 between tamping sites, the intermittently displaceable carrier frame being arranged between undercarriages 42 of machine 40 and having one end supported by undercarriage 43 on the track while its opposite end is longitudinally displaceably supported on the machine frame. Carrier frame 44 supports track lifting and lining unit 46, and respective tamping head 48 associated with each rail (see FIGS. 6 and 7), each tamping head comprising tamping tool carrier frame 55 supporting pairs 47 of vibratory and reciprocable tamping tools 59. Ballast distributing device 49 comprises substantially vertically extending ballast distributing tubes 50 arranged centrally between tamping tool carrier frames 55 of tamping heads 48 and respective branch tubes 56 extending from a lower end of each vertically extending tube towards each tamping tool carrier frame, the branch tubes being affixed to the carrier frames and having outlets 57 associated with tamping tools 59 of each tamping head connected thereto. Bin 51 is supported on carrier frame 44 and the upper ends of ballast distributing tubes 50 are in communication with the bin while ballast distributing attachments 58 are detachably connected to the lower ends of branch tubes 56, each attachment having two transversely spaced outlets 57 respectively associated with each tamping tool 59. Ballast delivery funnel 52 is mounted on machine frame 60 above bin 51 to deliver ballast thereto. Ballast storage car 54 is coupled to machine 40 and the bottom of the car is constituted by a conveyor band driven in the direction of the arrow, i.e. in the operating direction of machine 40, to convey ballast stored in the car to an input end of conveyor arrangement 53 whose output end discharges the conveyed ballast into funnel 52. Funnel-shaped bin 50, which receives the ballast from funnel 52, is arranged centrally between tamping heads 48 and ballast distributing tubes 50 are connected to respective ends of the bin. To enable the discharge of ballast from outlets 57 to be suitably controlled, remote-controllable valves may be provided in branch tubes 56 or in attachments 58 for selectively opening and closing outlets 57.

During the continuous advancement of machine frame 60, carrier frame 44 is cyclically displaced with respect to the machine frame and since bin 51 of the ballast distributing device is mounted on the carrier frame, the bin is cyclically displaced with the carrier frame with respect to ballast delivery funnel 52. As is clearly shown in FIG. 7, field-side and gage-side ballast outlets 57 are so positioned that the ballast will be distributed therefrom to the area where tamping tools 59 are immersed in the ballast for tamping.

Figure 8:
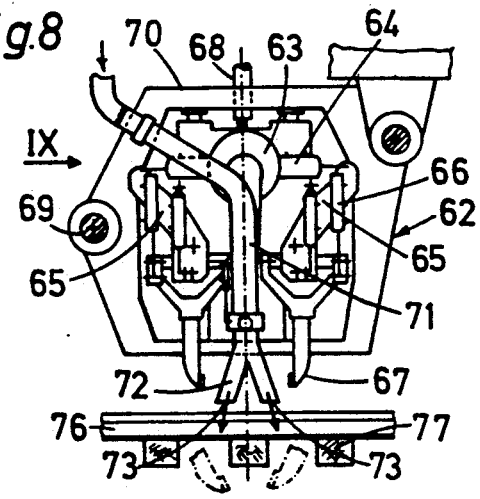
FIG. 8 is a view similar to that of FIG. 4, illustrating another embodiment of the ballast distributing device.
Figure 9:
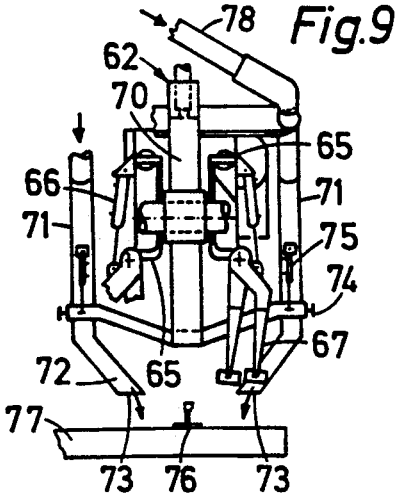
FIG. 9 is an end view of this embodiment, taken in the direction of arrow IX in FIG. 8.

FIGS. 8 and 9 illustrate switch tamping head 62 which comprises tamping tool carrier frame 70 having two opposite sides extending parallel to the longitudinal extension of the machine, a respective pair 65 of tamping tools 67 being arranged at each side. Drives 63, 64 are linked to the pairs of tamping tools for vibrating and reciprocating the same, each tamping tool 67 being independently transversely pivotal by an independent drive 66. Tamping head is vertically adjustable by drive 68 on tamping tool carrier frame 70 which is transversely displaceably supported on transverse guide posts 69. In this embodiment, the ballast distributing device comprises respective ballast distributing tube 71 extending centrally between each pair 65 of tamping tools 67 and having two outlets 73 respectively associated with each tamping tool of the pair. As in the previously described embodiments, ballast distributing attachment 72 is detachably screwed at 74 to a lower end of each ballast disributing tube 71 affixed to the tamping tool carrier frame and, in this embodiment, outlets 73 are spaced from each other in a longitudinal direction extending parallel to rail 76 and ballast distributing attachments 72 are angled towards rail 76 for discharging ballast into the cribs adjacent ties 77 in the range of the reciprocating tamping tools. Remote-controlled drive 75 is linked to a pivotal valve at the lower end of ballast distributing tube 71 to enable the ballast flow through the tube to be controlled. Ballast distributing tube 71 has an upper portion which is articulated to a vertically extending lower portion of the tube and extends transversely to the track, the upper tube portion being telescopingly extensible s that the tube is partly flexible to enable tamping head 62 to be transversely displaceable.

What is claimed is:

1. A ballast tamping machine mounted for mobility in an operating direction on a railroad track comprising two rails fastened to ties supported on a ballast bed, which comprises (a) a tamping head comprising pairs of vibratory tamping tools immersible in the ballast bed and reciprocable in the operating direction and opposite thereto for tamping ballast under the ties, (b) a track lifting and lining unit preceding the tamping head in the operating direction, and (c) a device for substantially uniformly distributing ballast, the device comprising a ballast storage container and ballast distributing tubes arranged to receive ballast from the container, each tube having an outlet remote from the container and adjacent a respective one of the tamping tools for discharging ballast at the respective tamping tool.

2. The ballast tamping machine of claim 1, wherein each outlet precedes the adjacent tamping tool in the direction of reciprocation of each pair of tamping tools.

3. The ballast tamping machine of claim 1, wherein the tamping head comprises a tamping tool carrier frame and the ballast distributing tubes are mounted on the carrier frame and are at least partially flexible, a respective one of the outlets being connected to one end of a respective one of the ballast distributing tubes, and the ballast distributing device further comprising a funnel-shaped bin communicating with an end of the ballast distributing tubes opposite the one end thereof.

4. The ballast tamping machine of claim 3, wherein the carrier frame defines respective bores forming a part of the ballast distributing tubes, each bore having an end at the lower end of the carrier frame forming the one end to which a respective one of the outlets is connected.

5. The ballast tamping machine of claim 4, wherein a flexible tubing connects the bin to an upper end of each bore to form the flexible part of the ballast distributing tubes.

6. The ballast tamping machine of claim 3, wherein the ballast storage container is arranged above the bin and in communication therewith.

7. The ballast tamping machine of claim 6, wherein the ballast distributing device further comprises a ballast conveyor band and a drive for driving the conveyor band in a conveying direction towards the bin, the conveyor band forming a bottom of the storage container.

8. The ballast tamping machine of claim 6, wherein the ballast distributing device further comprises a ballast conveyor arrangement arranged above the ballast storage container, the ballast conveyor arrangement having an input end and an output end arranged to discharge conveyed ballast into the storage container, and a vertically adjustable ballast sweeping device arranged rearwardly of the outlets in the operating direction to sweep up ballast and to deliver the swept-up ballast to the input end of the ballast conveyor arrangement.

9. The ballast tamping machine of claim 8, further comprising a vertically adjustable central ballast plow arranged between the outlets and the ballast sweeping device for plowing ballast in a central region of the track between the rails, and a shoulder plow at each side of the machine and preceding the central plow in the operating direction for plowing ballast at shoulders of the track.

10. The ballast tamping machine of claim 1, comprising a second tamping head, each of the tamping heads being associated with one of said rails, each tamping head comprising a tamping tool carrier frame, and a second ballast distributing device, a respective one of the ballast distributing devices being associated with a respective one of said tamping heads, the ballast distributing tubes being at least partially flexible and mounted on the carrier frames, a respective one of the outlets being connected to one end of a respective one of the ballast distributing tubes, each ballast distributing device further comprising a funnel-shaped bin communicating with an end of the ballast distributing tubes opposite the one end thereof, the ballast storage container being arranged above the bins and in communication therewith, two ballast conveyor bands forming a bottom of the storage container and a drive for driving each conveyor band in a conveying direction towards the bin, the bottom conveyor bands being arranged in a common horizontal plane side-by-side in a direction extending transversely to the machine.

11. The ballast tamping machine of claim 1, wherein the tamping head comprises a tamping tool carrier frame having two opposite sides extending parallel to the longitudinal extension of the machine, a respective one of the pairs of tamping tools being arranged at each side, and the ballast distributing device comprises a respective one of the ballast distributing tubes extending centrally between each pair of tamping tools and having two of said outlets respectively adjacent each tamping tool of the pair.

12. The ballast tamping machine of claim 1, comprising a second tamping head, a respective one of the tamping heads being associated with each rail, each tamping head comprising a tamping tool carrier frame, and wherein the ballast distributing tubes comprise a substantially vertically extending tube arranged centrally between the tamping tool carrier frames and respective branch tubes extending from a lower end of the vertically extending tube towards each carrier frame, the branch tubes being affixed to the carrier frames and having the outlets adjacent the tamping tools of each tamping head connected thereto.

* * * * *